US008882306B2

(12) United States Patent
Min

(10) Patent No.: US 8,882,306 B2
(45) Date of Patent: Nov. 11, 2014

(54) LIGHTING DEVICE

(71) Applicant: Byeongguk Min, Seoul (KR)

(72) Inventor: Byeongguk Min, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 3 days.

(21) Appl. No.: 13/759,664

(22) Filed: Feb. 5, 2013

(65) Prior Publication Data

US 2014/0029269 A1 Jan. 30, 2014

(30) Foreign Application Priority Data

Jul. 27, 2012 (KR) ..... 10-2012-0082219

(51) Int. Cl.
*F21V 3/00* (2006.01)
*F21V 17/08* (2006.01)

(52) U.S. Cl.
CPC ..... *F21V 17/08* (2013.01)
USPC ..... 362/311.06; 362/652

(58) Field of Classification Search
CPC ..... F21V 5/04; F21V 5/00
USPC ..... 362/311.06, 649, 650, 364, 311.01, 362/651, 652
See application file for complete search history.

(56) References Cited

U.S. PATENT DOCUMENTS

| | | | | |
|---|---|---|---|---|
| 7,708,452 | B2 * | 5/2010 | Maxik et al. | 362/650 |
| 8,182,110 | B2 * | 5/2012 | Jiang et al. | 362/245 |
| 2005/0254246 | A1 * | 11/2005 | Huang | 362/362 |
| 2007/0236935 | A1 * | 10/2007 | Wang | 362/294 |
| 2007/0242461 | A1 * | 10/2007 | Reisenauer et al. | 362/294 |
| 2010/0073907 | A1 * | 3/2010 | Wanninger et al. | 362/97.1 |
| 2011/0128730 | A1 * | 6/2011 | Chiu | 362/235 |

* cited by examiner

*Primary Examiner* — Evan Dzierzynski
(74) *Attorney, Agent, or Firm* — KED & Associates, LLP

(57) ABSTRACT

Disclosed is a lighting device including a body provided with a cavity in an upper part, a power supply disposed in the body to supply power, a case disposed in the cavity, the case including an electrode unit detachably connected to the power supply, and a light source disposed in the case and electrically connected to the electrode unit. Disclosed is also a lighting device including a body provided with a cavity in an upper part, a power supply disposed in the body to supply power, a case disposed in the cavity, the case including an electrode unit detachably connected to the power supply and a case body connected to the electrode unit, and a light source disposed in the case body and electrically connected to the electrode unit to emit light.

17 Claims, 9 Drawing Sheets

LIGHTING DEVICE

CROSS-REFERENCE TO RELATED APPLICATION

This application claims the priority benefit of Korean Patent Application No. 10-2012-0082219, filed on Jul. 27, 2012, in the Korean Intellectual Property Office, the disclosure of which is incorporated herein by reference.

BACKGROUND

1. Field

Embodiments relate to a lighting device.

2. Description of the Related Art

In general, indoor or outdoor light bulbs or fluorescent lights are widely used. Light bulbs or fluorescent lights should be frequently replaced due to short lifespan thereof. Also, conventional fluorescent lights deteriorate and luminance gradually decreases with time.

In order to solve these problems, a variety of types of lighting modules using light-emitting diodes (LEDs) capable of realizing superior control, rapid response speed, high electric light conversion efficiency, long lifespan, low consumption power, superior brightness and sensitive lighting are developed.

Light emitting diodes (LEDs) are devices which convert electric signals into light using characteristics of compound semiconductors. Light emitting diodes (LEDs) have advantages of low consumption power, semi-permanent lifespan, rapid response speed, safety and eco-friendliness, as compared to conventional light sources such as fluorescent and incandescent lighting. Accordingly, a great deal of research to replace conventional light sources with light emitting diodes is underway and use of LEDs as light sources of lighting devices such as indoor and outdoor liquid crystal display devices, electronic signboards and streetlights is increasing.

SUMMARY

Embodiments provide a lighting device in which specific components are detachably mounted, to enable easy repair and replacement of the components.

In one embodiment, a lighting device includes: a body provided with a cavity in an upper part; a power supply disposed in the body to supply power; a case disposed in the cavity, the case including an electrode unit detachably connected to the power supply; and a light source disposed in the case and electrically connected to the electrode unit.

In another embodiment, a lighting device includes: a body provided with a cavity in an upper part; a power supply disposed in the body to supply power; a case disposed in the cavity, the case including an electrode unit detachably connected to the power supply and a case body connected to the electrode unit; and a light source disposed in the case body and electrically connected to the electrode unit to emit light.

BRIEF DESCRIPTION OF THE DRAWINGS

Details of the embodiments will be more clearly understood from the following detailed description taken in conjunction with the accompanying drawings, in which.

DETAILED DESCRIPTION OF EMBODIMENTS

Figure 1:
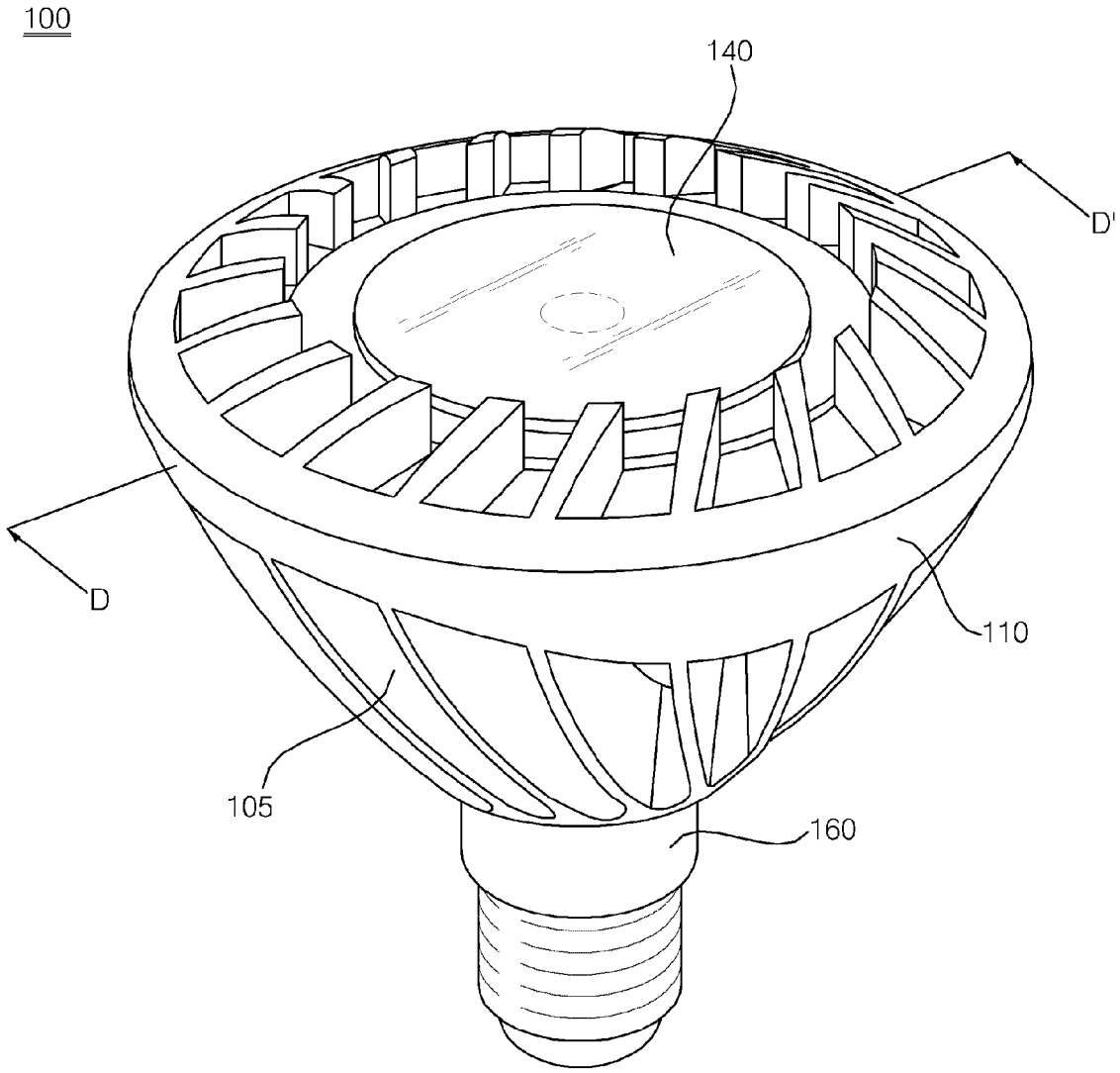
FIG. 1 is a perspective view illustrating a structure of a lighting device according to one embodiment.

Reference will now be made in detail to embodiments, examples of which are illustrated in the accompanying drawings. However, the present disclosure may be embodied in many different forms and should not be construed as limited to the embodiments set forth herein. Rather, these embodiments are provided so that this disclosure will be thorough and complete, and will fully convey the scope of the disclosure to those skilled in the art. The present disclosure is defined only by the categories of the claims. In certain embodiments, detailed descriptions of device constructions or processes well known in the art may be omitted to avoid obscuring appreciation of the disclosure by a person of ordinary skill in the art. Wherever possible, the same reference numbers will be used throughout the drawings to refer to the same or like parts.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each layer is exaggerated, omitted, or schematically illustrated for convenience of description and clarity. Also, the size or area of each constituent element does not entirely reflect the actual size thereof.

Angles or directions used to describe the structures of light emitting devices according to embodiments are based on those shown in the drawings. Unless there is, in the specification, no definition of a reference point to describe angular positional relations in the structures of the light emitting devices, the associated drawings may be referred to.

Hereinafter, embodiments will be described in more detail with reference to the annexed drawings.

Figure 2:
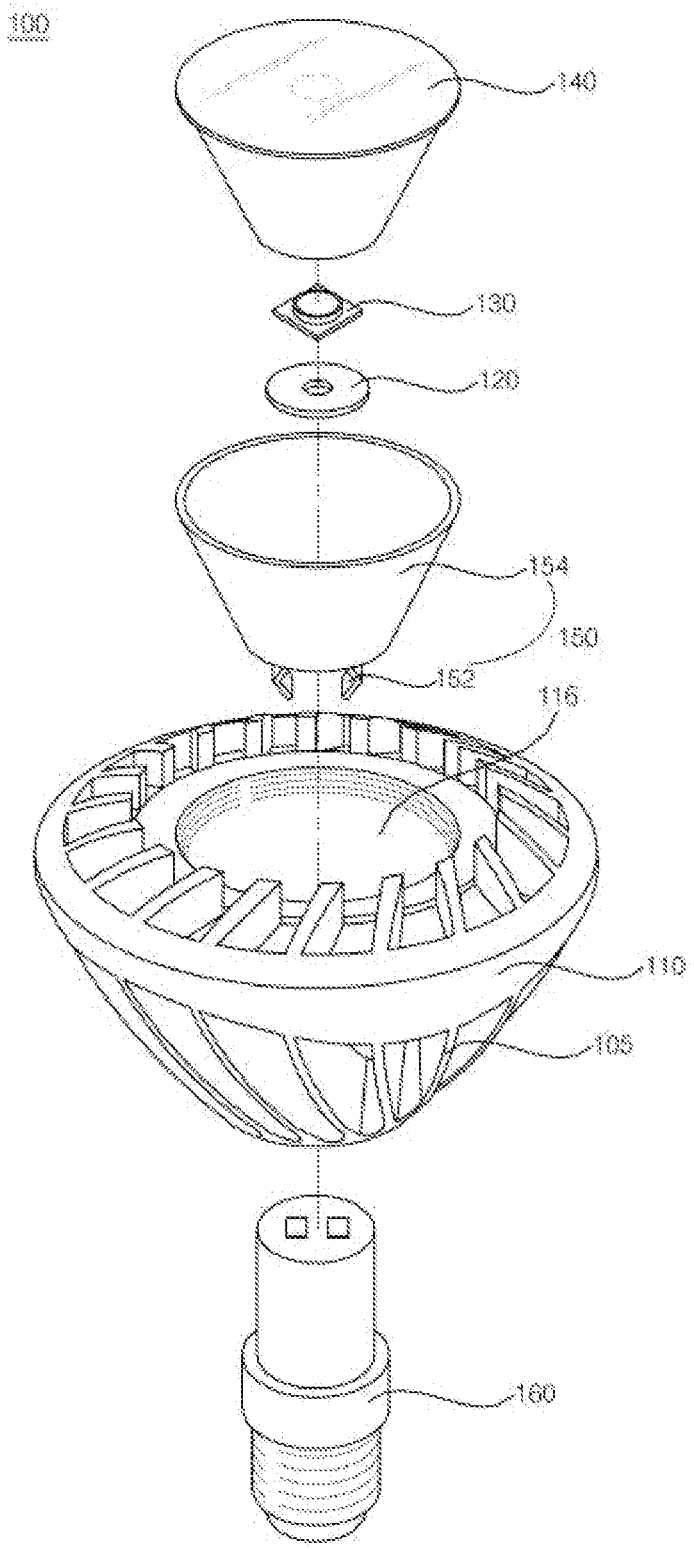
FIG. 2 is an exploded perspective view illustrating a lighting device according to one embodiment.
Figure 3:
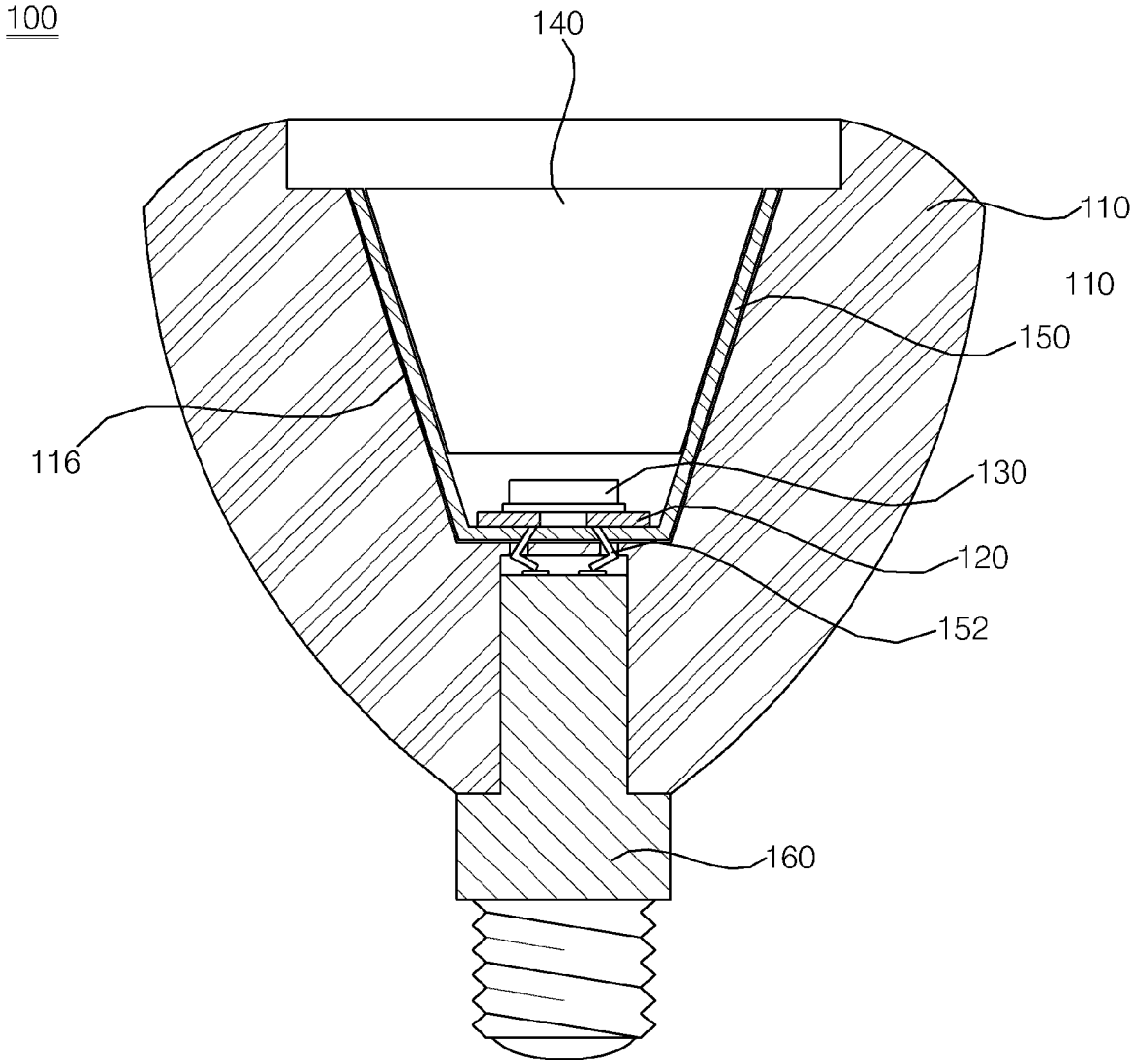
FIG. 3 is a sectional view illustrating the cross-section taken along the direction D-D' of the lighting device of FIG. 1.

FIG. 1 is a perspective view illustrating a lighting device 100 according to one embodiment. FIG. 2 is an exploded perspective view illustrating a lighting device 100 according to one embodiment. FIG. 3 is a sectional view illustrating the cross-section taken along the direction of D-D' of the lighting device 100 of FIG. 1.

Referring to FIGS. 1 to 3, the lighting device 100 of one embodiment includes a body 110 provided in an upper part thereof with a cavity 116 and provided with an inner area, a power supply 160 disposed in the inner area of the body 110 to supply power, a case 150 disposed in the cavity 116, the case 150 including an electrode unit 152 detachably connected to the power supply 160, and a light source 130 disposed in the case 150 and electrically connected to the electrode unit 152.

The body 110 receives light generated in the light source 130 and radiates the light. The body 110 may be made of a material having superior light emission efficiency. For example, the body 110 may comprise at least one of aluminum (Al), nickel (Ni), silver (Ag), tin (Sn) and a plastic.

When the body 110 comprises a metal material, electric insulating treatment between the body 110 and the power supply 160 may be performed, although the disclosure is not limited thereto. In another embodiment, when the body 110 is made of a plastic having low electric conductivity, the power supply 160 may contact the body 110, although the disclosure is not limited thereto.

The body 110 may comprise a thermoconductive plastic having thermoconductivity higher than a general plastic. The thermoconductive plastic may have a structure that exhibits maximum heat-radiation performance making the best of characteristics such as conduction, convection, and radiation.

The body 110 is provided in an upper part thereof with a cavity 116. The cavity 116 may be formed by a recessed portion of the upper part of the body 110. The cavity 116 may be formed by the bottom surface of a portion of the body 110 and the inside wall that forms a slope with the bottom surface. A case 150 may be disposed in the cavity 116.

The body 110 may have an inner area. The body 110 may include a power supply 160 in the inner area. The cavity 116 disposed in the upper part of the body 110 is connected to a region where the power supply 160 is disposed.

The lighting device 100 may further include a substrate 120 disposed on the bottom surface of the case 150 described below.

The substrate 120 may be electrically connected to the light source 130. The substrate 120 may be electrically connected to the power supply 160. The substrate 120 receives power from the power supply 160 and transfers the same to the light source 130. For example, the substrate 120 may be electrically connected to the electrode unit 152 disposed in the case 150. The substrate 120 may electrically connect the light source 130 to the electrode unit 152. For example, the substrate 120 receives power from the electrode unit 152 and transfers the same to the light source 130.

The substrate 120 may include a circular plate shape, but it may include various shapes without limiting thereto. For example, the substrate 120 may have a polygonal plate shape.

The substrate 120 may be a circuit pattern-printed insulator. For example, the substrate 120 may include a general printed circuit board (PCB), a metal core PCB, flexible PCB, a ceramic PCB or the like. The substrate 120 may be a chip on board (COB) that is integrated with the light source 130, although the disclosure is not limited thereto.

The substrate 120 may include a material that efficiently reflects light. The substrate 120 may have an upper surface that has color such as white or silver, capable of efficiently reflecting light.

The lighting device 100 may further include a heat-radiation pad (not shown) between the substrate 120 and the case 150. The heat-radiation pad (not shown) may transfer heat, which is generated in the light source 130 and is then transferred to the substrate 120, to the case 150.

The substrate 120 may be disposed in the body 110. The heat-radiation pad (not shown) may include a portion that is disposed on the bottom surface of the case 150. The substrate 120 may be disposed between the bottom surface of the case 150 and the light source 130.

The heat-radiation pad (not shown) may be made of a highly thermoconductive material. The heat-radiation pad (not shown) receives heat generated in the light source 130. The heat-radiation pad (not shown) transfers heat from the light source 130 into the case 150.

The light source 130 may be disposed on the bottom surface of the case 150. The substrate 120 may be disposed between the light source 130 and the bottom surface of the case 150. A heat-radiation pad (not shown) to transfer heat may be disposed between the light source 130 and the bottom surface of the case 150, but the disclosure is not limited thereto.

The light source 130 may be electrically connected to the power supply 160 described below. The light source 130 may emit light. The light source 130 may include an element that emits light using characteristics of semiconductor materials. For example, the light source 130 may include a light emitting diode (LED).

The light emitting diode (not shown) may convert electrical signals into infrared light or visible light using compound semiconductor characteristics. The light emitting diode (not shown) may be electrically connected to a lead frame (not shown) of a light emitting device package (not shown).

The light source 130 may include a red, green, blue or white light emitting diode that emits red, green, blue or white light, but the type and number thereof are not limited. The light emitting diode may be of a lateral or vertical type, but the disclosure is not limited thereto.

The light source 130 may include a phosphor. The phosphor absorbs light and thereby emits light having a changed wavelength. The phosphor may include at least one of yellow, red and green phosphors, when the light emitting diode is a blue light emitting diode. For example, the phosphor may include at least one of Garnet (YAG, TAG), silicate, nitride, and oxynitride.

The light source 130 may face the bottom of the lens 140. The light source 130 may be spaced from the lens 140 described below. The light source 130 is spaced from the lens 140 by a predetermined distance to allow a greater amount of light to be incident upon the lens 140.

The power supply 160 may be disposed in the body 110. The power supply 160 may be inserted into an inner area provided in the body 110. The power supply 160 may be electrically connected to the substrate 120. The power supply 160 may be electrically connected through the substrate 120 to the light source 130 and control operation of the light source 130, but the disclosure is not limited thereto.

The power supply 160 may include a support substrate (not shown) and a plurality of components (not shown) mounted on the support substrate (not shown).

The power supply 160 may convert alternating current supplied from the outside into direct current that may be stably used for the lighting device. The power supply 160 may supply a voltage or current required for the lighting device.

Examples of the plurality of components may include, but are not limited to, a direct current convertor that converts alternating current supplied from an exterior power source into direct current, a driver (not shown) to control driving of the light source 130, an electrostatic discharge (ESD) protective element (not shown) to protect the light source 130 from an electric shock (not shown) or the like. The power supply 160 may be provided in a lower part thereof with a socket connected to an exterior power source.

The power supply 160 prevents noise of alternating current input outside from being transferred to the light source 130. The power supply 160 may include a band-pass filter that removes ripples or noise of the power rectified into direct current. The power supply 160 may convert filtered direct current into power that satisfies specifications required for the light source 130.

The lens 140 is disposed on the light source 130 and contacts the case 150. The lens 140 may be disposed in the case body 154. The side and lower surface of the lens 140 may be surrounded by the body 154 of the case 150, but the disclosure is not limited thereto. In another embodiment, the lens 140 may face the lower surface. The lens 140 passes through light emitted from the light source 130 and emits the same outside. The lens 140 may focus or emit light emitted from the light source 130. The lens 140 may have a circular shape, but the shape thereof is not limited. The shape of the lens 140 may be changed according to the shape of the case 150. For example, one side of the lens 140 contacts the top of the case 150 and the bottom surface thereof may extend toward the light source 130. A method for connecting the lens 140 to the case 150 will be described in detail in the section illustrated with reference to FIG. 4.

The lens 140 may partially or entirely have a predetermined curvature. The lens 140 may be spaced from the light source 130 by a predetermined distance. The lens 140 may extend in a depth direction of the cavity 112 such that it corresponds to the light source 130. When the number of the light sources 130 is plural, the lens 140 may have a plurality of parts that extend in the depth direction of the case 150 such that the parts correspond to the light sources 130.

The lens 140 may have a diameter that decreases from the top to the bottom. For example, the lens 140 has a maximum diameter in a part thereof that contacts the top of the case 150 and a minimum diameter in a part thereof that faces the light source 130. The lens 140 may have a cylindrical shape in which the diameter is changed according to height.

An adhesion unit (not shown) may be disposed between the lens 140 and the case 150. The adhesion unit (not shown) prevents movement of a region where the lens 140 is coupled to the case 150. The adhesion unit (not shown) may be filled between the lens 140 and the case 150. The adhesion unit (not shown) may include a material to adhere metal to non-metal. The adhesion unit (not shown) adheres the lens 140 to the case 150. The adhesion unit (not shown) enhances optical orientation or physical durability of the lighting device 100. The adhesion unit (not shown) may include silicone (Si), but the material of adhesion unit is not limited thereto.

The case 150 may be disposed in the cavity 116 of the body 110. The case 150 may be recessed. For example, the case 150 may have a recessed cup shape provided at an inside thereof with a bottom surface, but the shape thereof may be changed according to the shape of the cavity 116 of the body 110, without limitation thereto. The substrate 120 or the light source 130 may be disposed on the bottom surface of the inside of the case 150.

The case 150 may be made of a highly thermo-conductive material. The case 150 may transfer heat generated in the light source 130 to the body 110. The bottom or side surface of the outside of the case 150 contacts the body 110 to transfer heat, but the disclosure is not limited thereto.

Referring to FIG. 2, the case 150 may include a case body 154 connected to the electrode unit 152. The case body 154 may have a cup shape. The electrode unit 152 passes through a portion of the case body 154. For example, the electrode unit 152 may pass through the bottom surface of the case body 154.

The case 150 may include an electrode unit 152 electrically connected to the power supply 160. The electrode unit 152 may be disposed in a portion on the bottom surface of the case 150. The electrode unit 152 may be detachable from the power supply 160. The electrode unit 152 may contain an electrically conductive material.

The electrode unit 152 may be electrically connected to the power supply 160. The electrode unit 152 may transfer power from the power supply 160 to the light source 130. For example, the electrode unit 152 is electrically connected to the substrate 120 to supply power to the light source 130 electrically connected to the substrate 120, but the disclosure is not limited thereto.

Figure 4:
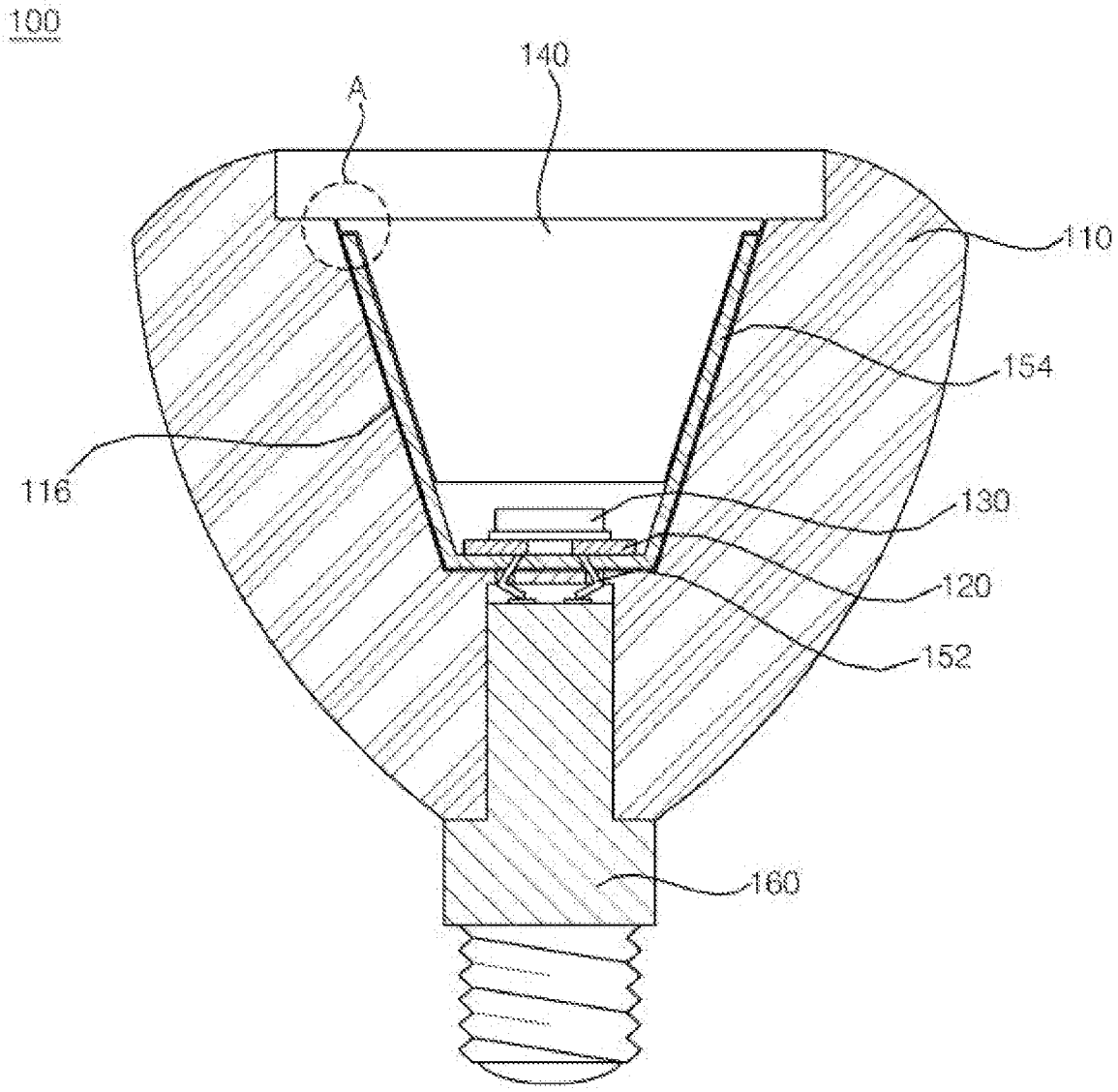
FIG. 4 is a partially enlarged view of the lighting device of FIG. 3.

FIG. 4 is a partially enlarged view of the lighting device of FIG. 3.

Referring to FIG. 4, the electrode unit 152 may be disposed on the bottom surface of the case 150. The electrode unit 152 may be electrically connected to the substrate 120. The electrode unit 152 may include a first case electrode and a second case electrode that have different electric polarities.

In the lighting device 100 of one embodiment, the electrode unit 152 may be having a clamp shape. The electrode unit 152 may be a clamp which is firmly coupled to the power supply 160. The electrode unit 152 has a clamp shape to separate the light source 130 from the power supply 150.

The case body 154 may be a cup shape. The lens 140 may have a portion that extends to the top of the case body 154. The extension part of the lens 140 is disposed on the top of the case body 154 to separate the lens 140 from the light source 130.

In the lighting device 100 of one embodiment, the lens 140 may be disposed on the top of the light source 130. The lens 140 focuses light irradiated from the light source 130 and emits the same upward. The lens 140 may be spaced from the light source 130. The lens 140 may be spaced from the light source 130 by a predetermined distance to prevent transfer of exterior shock to the light source 130. The lens 140 may have a portion that contacts the case 150.

The lens 140 may include a region (A) that is disposed on the top of the case 150. The top of the lens 140 may extend in a circumferential direction. The lens 140 extends in the circumferential direction and is disposed on the end of the case 150.

An adhesion unit (not shown) may be disposed between the region (A) of the lens 140 and the top of the case 150. The adhesion unit (not shown) may include a material to adhere metal to non-metal. The adhesion unit (not shown) adhered the lens 140 to the case 150 to prevent introduction of foreign matter into the case 150.

Figure 5:
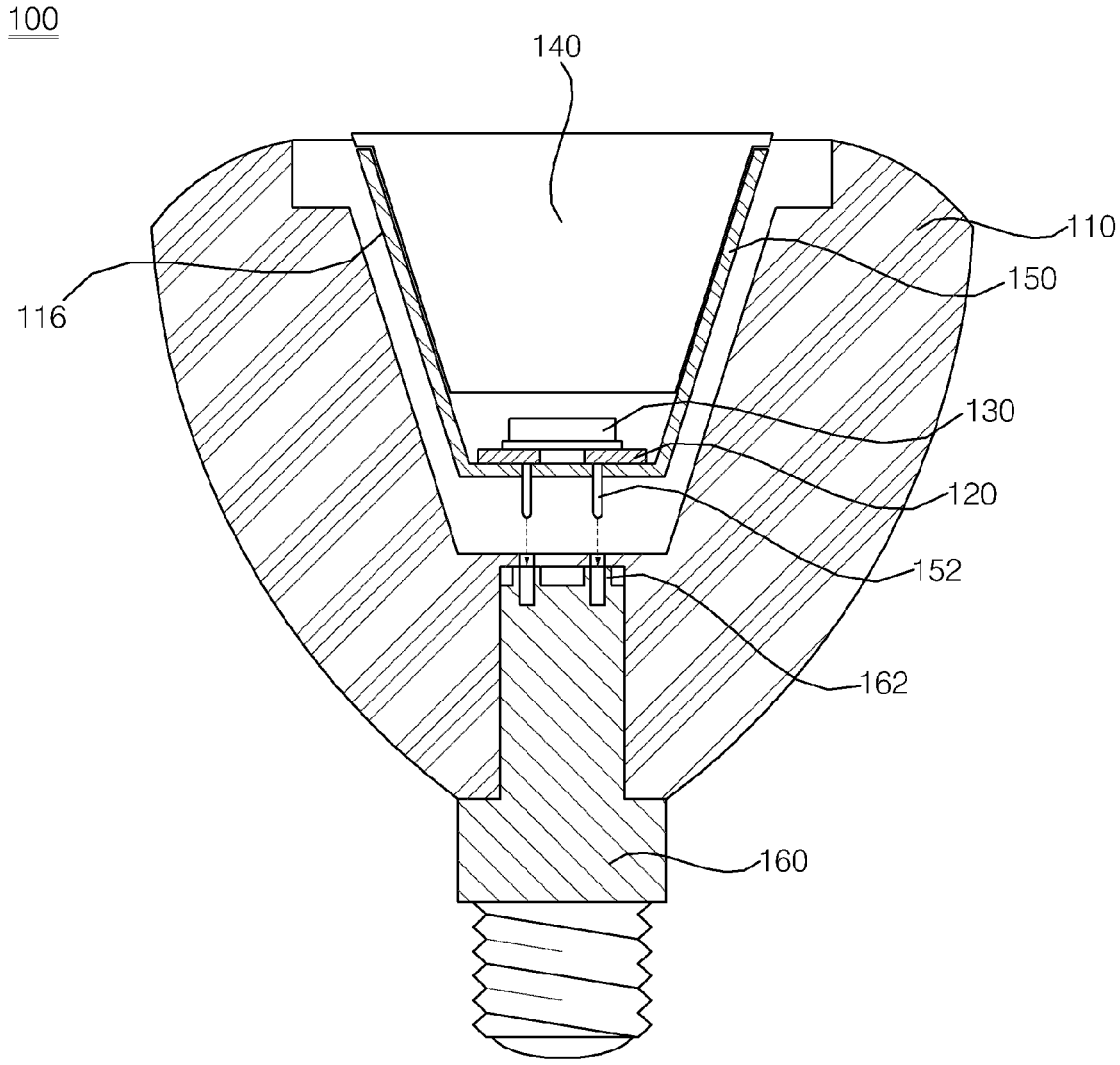
FIG. 5 is a sectional view illustrating a lighting device according to another embodiment.

FIG. 5 is a sectional view illustrating a lighting device 100 according to another embodiment.

Referring to FIG. 5, the case 150 may be provided in a lower part thereof with an electrode unit 152 having a rod shape.

The case 150 may be made of a highly thermo-conductive material. The case 150 may contain metal. When the case 150 contains metal, the metal region may be electrically isolated from the electrode unit 152. A portion of the electrode unit 152 may be coated with an electrically conductive material. The electrode unit 152 has a portion coated with an electrically conductive material, which is electrically isolated from other metal region.

The power supply 160 may include two power supply electrodes having different polarities to supply power to the light source 130 and a connector connected to the power supply electrodes.

The power supply 160 may include a connector 162 connected to the electrode unit 152. The connector 162 connects the power supply electrodes included in the power supply 160 to the electrode unit 152 having a rod shape included in the case 152, to constitute an electric circuit. The connector 162 fixes the electrode unit 152 having a rod shape. The connector 162 may electrically connect the electrode unit 152 to the power supply electrodes. The connector 162 improves reliability of electric connection between the electrode unit 152 and the power supply electrodes.

The connector 162 includes a bent metal plate and fixes the electrode unit 152 by pressing the rod-shaped electrode unit 152 based on elasticity of the metal plate, but the disclosure may include various embodiments without limitation thereto.

The lighting device 100 includes the connector 162 to connect the rod-shape electrode unit 152 to the power supply electrodes, thus maximizing electric reliability.

Figure 6:
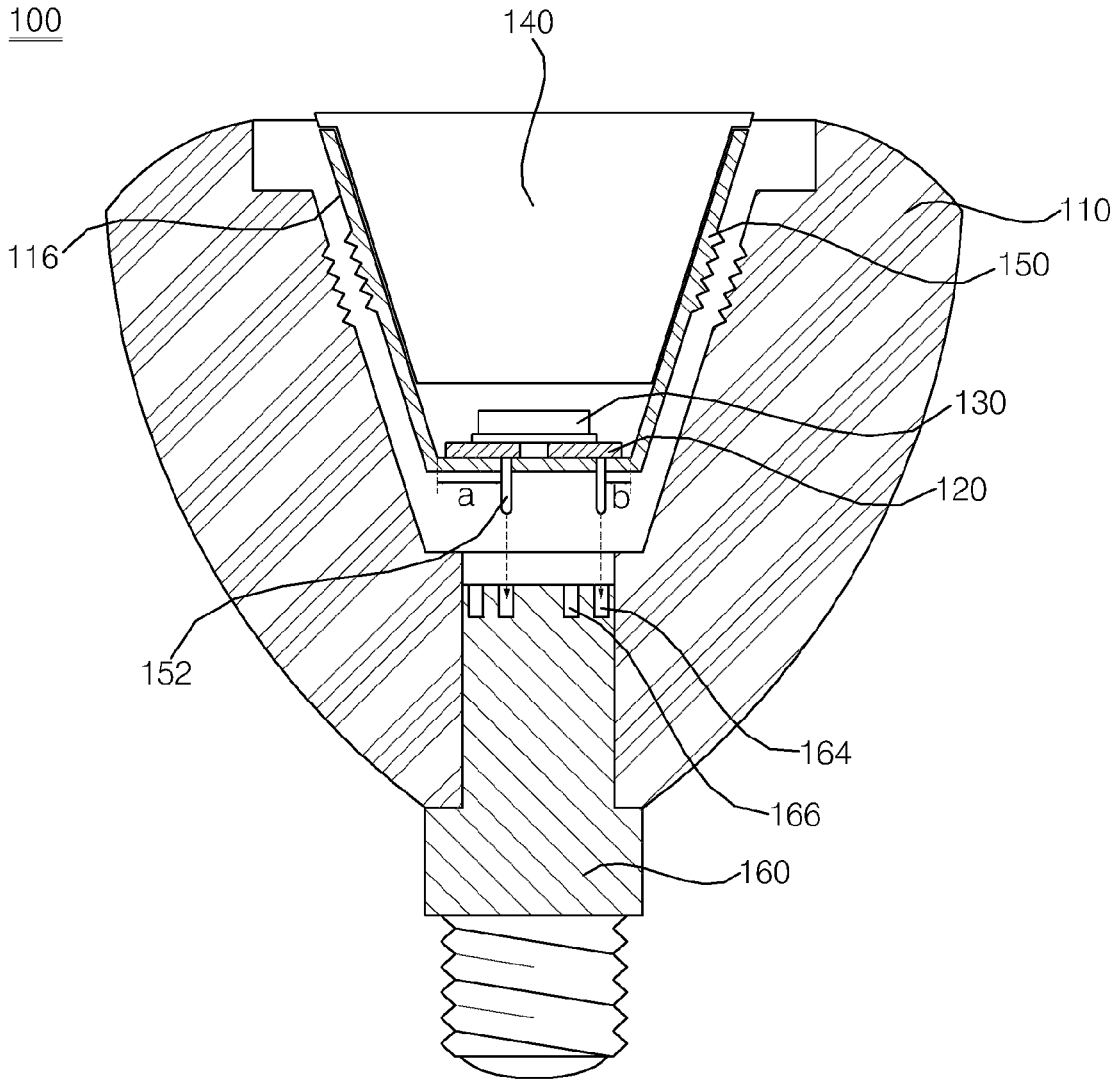
FIG. 6 is a sectional view illustrating the lighting device according to another embodiment.
Figure 7:
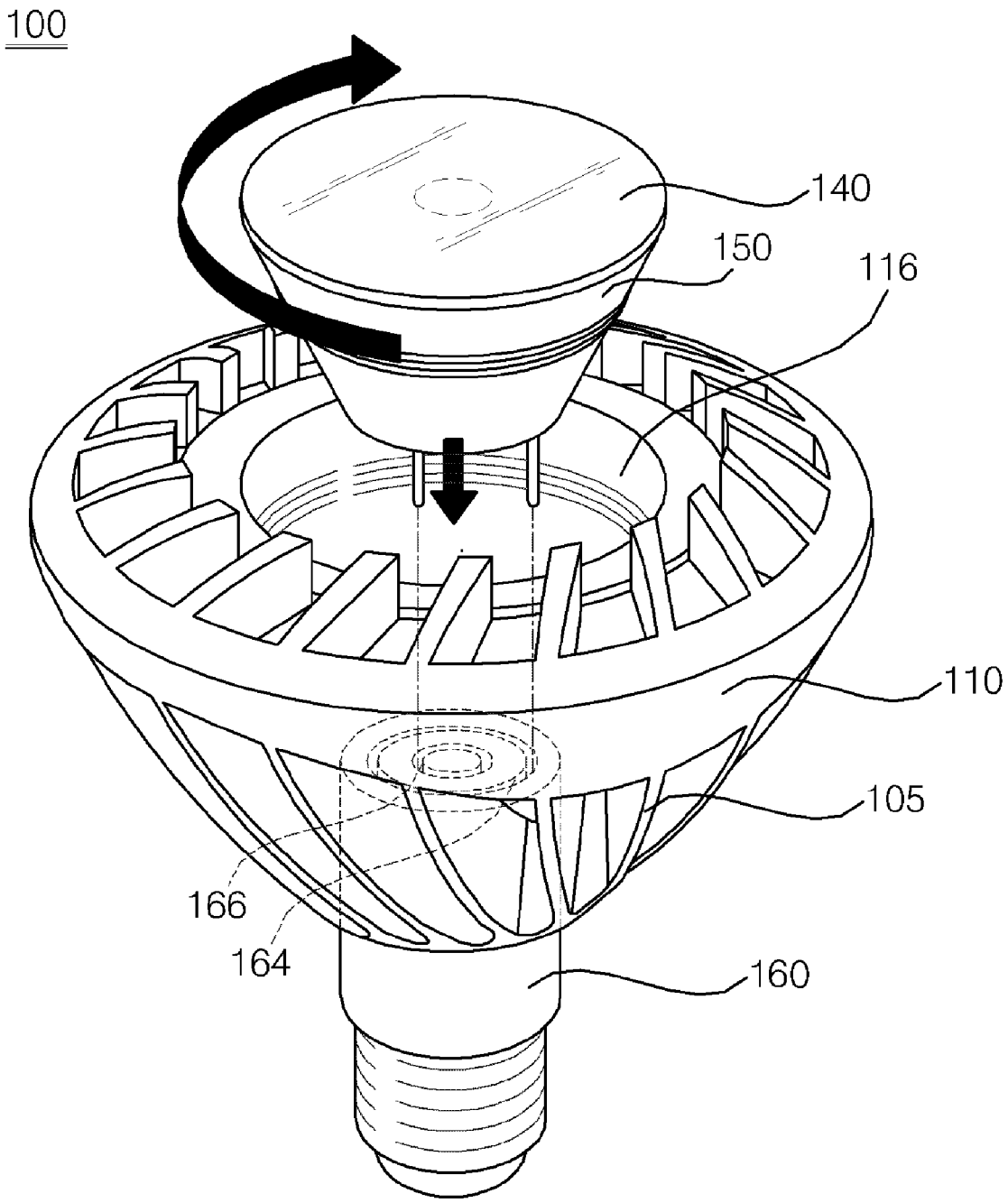
FIG. 7 is a perspective view illustrating the lighting device of FIG. 6.

FIG. 6 is a sectional view illustrating the lighting device 100 according to another embodiment. FIG. 7 is a perspective view illustrating the lighting device 100 of FIG. 6.

Referring to FIGS. 6 and 7, the case 150 may be coupled to the body 110 by screw coupling.

The case 150 may be provided at the outside thereof with a first screw 154. The body 110 may be provided at the side wall to provide the cavity 116 with a second screw 112. The first screw 154 may be coupled to the second screw 112.

The case 150 may include a plurality of electrode units 152. For example, the plurality of electrode units 152 may include a first case electrode and a second case electrode that have different distances from the circumference of the bottom surface of the case 150. The distance (a) between the first case electrode and the circumference of the bottom surface of the case 150 may be different from the distance (b) between the second case electrode and the circumference of the bottom surface of the case 150.

The first case electrode and the second case electrode may correspond to a first power supply electrode 166 and a second power supply electrode 164 of the power supply 160, respectively.

The power supply 160 may include a plurality of power supply electrodes 164 and 166 that have different polarities to supply power to the light source 130. The power supply 160 may include a first power supply electrode 166 corresponding to the first case electrode and a second power supply electrode 164 corresponding to the second case electrode.

The first power supply electrode 166 and the second power supply electrode 164 may have circular shapes that have different diameters. The first power supply electrode 166 and the second power supply electrode 164 have circular shapes that have different diameters, thus electrically connecting the power supply 160 to the electrode unit 152, although the case 150 is coupled to the body 110 by screw coupling.

Figure 8:
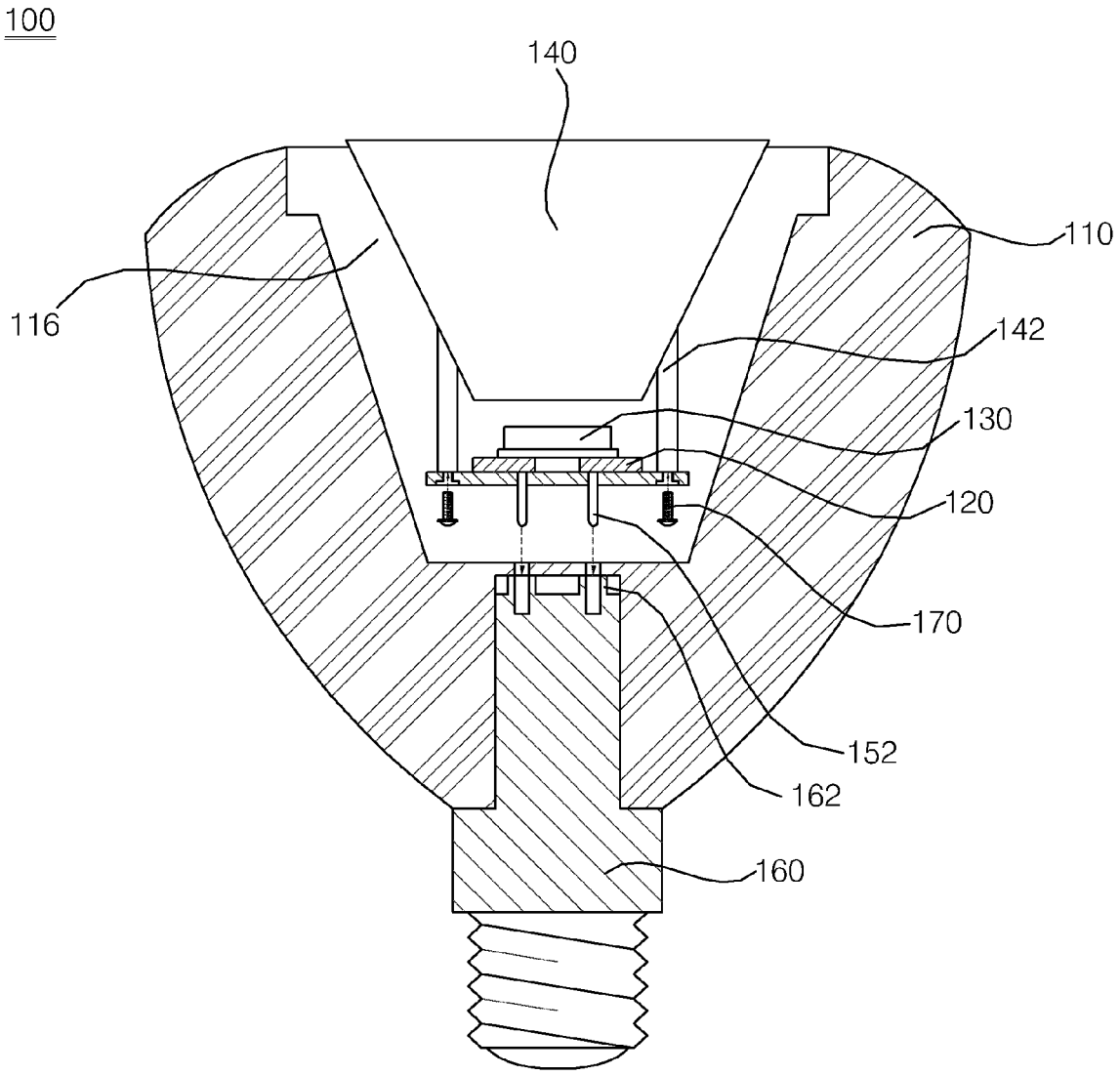
FIGS. 8 and 9 are sectional views illustrating the lighting device according to another embodiment.

FIG. 8 is a sectional view illustrating the lighting device 100 according to another embodiment.

Referring to FIG. 8, the lighting device 100 according to another embodiment may have a case 150 having a plate shape.

The lens 140 may include a column 142 that extends toward the case 150 from the side thereof. The column 142 may have a structure in which one side of the lens 140 extends toward the case 150, but the disclosure is not limited thereto. Alternatively, the column may surround the side of the lens.

The column 142 may be connected to the case 150. For example, the lighting device 100 may further comprise a screw nail 170 to connect the column 142 to the case 150. The screw nail 170 passes through the case 150 and is coupled to the column 142. The screw nail 170 fixes the case 150 and the lens 140 to improve optical stability of the lighting device 100.

Figure 9:
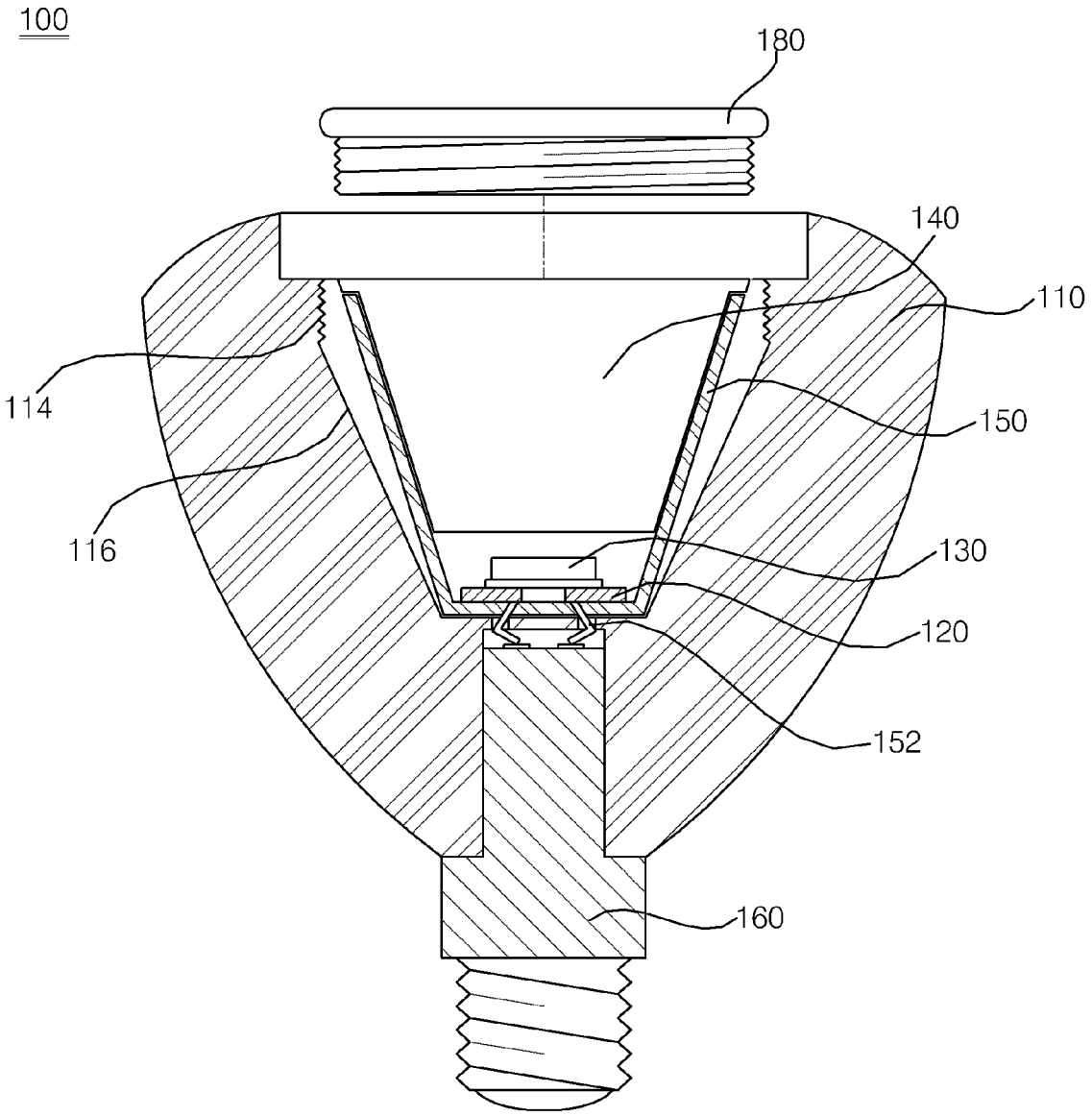

FIG. 9 is a sectional view illustrating a lighting device 100 according to another embodiment. Referring to FIG. 9, the lighting device 100 may further include a holder 180 disposed between the lens 140 and the body 110, to fix the lens 140 thereon.

The holder 180 may extend to the top of the body 110. The holder 180 may be coupled to the body 110. The holder 180 may be coupled to the body 110 to fix the lens 140. The holder 180 may extend to the top of a portion of the lens 140.

The holder 180 extends to the side or the top of the lens 140 to fix the lens 140. The holder 180 includes a screw groove on the surface thereof contacting the body 110 and the holder 180 is thus coupled to the body 110 through the screw groove by screw coupling. The body 110 is coupled to the holder 180 through the screw groove formed on the side wall to provide the cavity 116, but the disclosure is not limited thereto. For example, one or more grooves are formed on the side wall to provide the cavity 116 and the holder 180 is provided with one or more protrusions, and the grooves are coupled to the protrusions to connect the body 110 to the holder 180.

In some embodiments, the holder 180 may have a portion that is disposed on the top of the case 150. The holder 180 contacts the top of the case 150 and the top of the lens 140 and thereby fixes the lens.

In the lighting device according to one embodiment, a heat radiator to increase a surface area is provided at outside of the body, to increase heat radiation performance.

In the lighting device according to one embodiment, a power supply is provided in the body to realize electric stability.

In the lighting device according to one embodiment, a light source is detachably from a power supply to enable easy replacement of parts in which problems occur.

In the lighting device according to one embodiment, the electrode unit of the case has a rod shape to make detachment of the electrode unit from the power supply easy.

The lighting device according to one embodiment includes a clamp that is stably coupled to the power supply.

In the lighting device according to one embodiment, the power supply includes a connector to stably couple the power supply to the electrode unit of the case.

The lighting device according to one embodiment further includes a holder disposed between the case and the body to stably fix the case.

Particular features, structures, or characteristics described in connection with the embodiment are included in at least one embodiment of the present disclosure and not necessarily in all embodiments. Furthermore, the particular features, structures, or characteristics of any specific embodiment of the present disclosure may be combined in any suitable manner with one or more other embodiments or may be changed by those skilled in the art to which the embodiments pertain. Therefore, it is to be understood that contents associated with such combination or change fall within the spirit and scope of the present disclosure.

What is claimed is:

1. A lighting device comprising:

a body provided with a cavity in an upper part;

a power supply disposed in the body to supply power;

a case disposed in the cavity, the case including an electrode unit detachably connected to the power supply; and a light source disposed in the case and electrically connected to the electrode unit, wherein the case includes a first screw formed at an outside of the case, and the body includes a second screw coupled to the first screw, formed at a side wall to provide the cavity, wherein the electrode unit includes a first case electrode and a second case electrode, wherein a distance between the first case electrode and a circumference of a bottom surface of the case is different from a distance between the second case electrode and the circumference of the bottom surface of the case, and the power supply includes a first power supply electrode and a second power supply electrode corresponding to the first case electrode and the second case electrode, respectively, wherein the first power supply electrode and the second power supply electrode have circular shapes with different diameters.

2. The lighting device according to claim 1, wherein the case has a cup shape.

3. The lighting device according to claim 1, further comprising:

a lens to emit a light received from the light source toward outside, wherein the lens is disposed on a top of the case, wherein a portion of the lens extends toward a side.

4. The lighting device according to claim 3, wherein the lens is spaced from the light source.

5. The lighting device according to claim 3, wherein the case has a plate shape, the lens comprises a column that extends from the side of the lens toward the case, and the case is connected to the column.

6. The lighting device according to claim 5, further comprising:

a screw nail to connect the case to the column.

7. The lighting device according to claim 3, further comprising:

a holder having a portion disposed between the lens and the body, to connect to the lens.

8. The lighting device according to claim 7, wherein the holder extends to a top of the lens and a top of the body.

9. The lighting device according to claim 7, wherein the holder is provided with a screw groove on the surface contacting the body, and the holder is coupled to the body by screw coupling through the screw groove.

10. The lighting device according to claim 1, further comprising:

a substrate disposed on the bottom surface of the case, to electrically connect the light source to the electrode unit.

11. A lighting device comprising:

a body provided with a cavity in an upper part;

a power supply disposed in the body to supply power;

a case disposed in the cavity, the case including an electrode unit detachably connected to the power supply and a case body connected to the electrode unit; and a light source disposed in the case body and electrically connected to the electrode unit to emit light, wherein the electrode unit has a rod shape, and the power supply includes a connector to connect to the electrode unit, wherein th connector includes a bent metal plate to fix the electrode unit based on elasticity of the metal plate.

12. The lighting device according to claim 11, wherein the electrode unit passes through a portion of the case body.

13. The lighting device according to claim 11, further comprising:

a lens disposed in the case body and spaced from the light source.

14. The lighting device according to claim 13, wherein the case body has a cup shape, and the lens has a portion that extends toward the side and is disposed on a top of the case body.

15. The lighting device according to claim 13, wherein the lens is spaced from the light source.

16. The lighting device according to claim 13, wherein a portion of the electrode unit is coated with an electrically conductive material.

17. The lighting device according to claim 11, wherein based on the elasticity of the bent metal plate, the bent metal plate presses on the electrode unit to fix the position of the electrode unit inside of the bent metal plate.

* * * * *